US005368149A

United States Patent [19]

Ibarrola

[11] Patent Number: 5,368,149

[45] Date of Patent: Nov. 29, 1994

[54] PROCEDURE FOR PROCESSING ELECTRICAL SIGNALS USED IN VERIFYING COINS

[75] Inventor: Jesûs E. Ibarrola, Pamplona, Spain

[73] Assignee: Azkoyen Industrial, S.A., Peralta, Spain

[21] Appl. No.: 68,031

[22] Filed: May 28, 1993

[30] Foreign Application Priority Data

Jun. 1, 1992 [ES] Spain ..... 9201123

[51] Int. Cl.[5] ..... G07D 5/08

[52] U.S. Cl. ..... 194/317

[58] Field of Search ..... 194/303, 317, 318, 319

[56] References Cited

U.S. PATENT DOCUMENTS

| | | | |
|---|---|---|---|
| 1,625,979 | 4/1927 | Brinkerhoff . | |
| 3,415,256 | 12/1968 | Meloni . | |
| 3,712,441 | 1/1973 | Taylor . | |
| 4,105,105 | 8/1978 | Braum . | |
| 4,263,924 | 4/1981 | Johnson . | |
| 4,503,961 | 3/1985 | Chittleborough . | |
| 4,650,057 | 3/1987 | Koester . | |
| 4,690,263 | 9/1987 | Yokomori . | |
| 4,846,332 | 7/1989 | Quinlan | 194/317 |
| 4,893,706 | 1/1990 | Ibarrola . | |
| 4,946,019 | 8/1990 | Yamashita | 194/318 |
| 4,951,800 | 8/1990 | Yoshihara | 194/317 |
| 5,048,662 | 9/1991 | Yamashita et al. | 194/317 |
| 5,063,518 | 11/1991 | Chitty et al. . | |
| 5,067,604 | 11/1991 | Metcalf . | |
| 5,085,309 | 2/1992 | Adamson et al. . | |
| 5,191,956 | 3/1993 | Ibarrola | 194/317 |
| 5,191,957 | 3/1993 | Hayes | 194/318 |

FOREIGN PATENT DOCUMENTS

| | | |
|---|---|---|
| 0000010 | 12/1978 | European Pat. Off. . |
| 0184393 | 6/1986 | European Pat. Off. . |
| 0246993 | 11/1987 | European Pat. Off. . |
| 0323396 | 7/1989 | European Pat. Off. . |
| 0360506 | 3/1990 | European Pat. Off. . |
| 747958 | 6/1933 | France . |
| 2293749 | 7/1976 | France . |
| 603120 | 9/1934 | Germany . |
| 2825094 | 12/1979 | Germany . |
| 3009466 | 9/1981 | Germany . |
| 3512579 | 10/1986 | Germany . |
| 549841 | 12/1985 | Spain . |
| 555181 | 5/1986 | Spain . |
| 11006 | of 1892 | United Kingdom . |
| 727581 | 4/1955 | United Kingdom . |
| 1066389 | 4/1967 | United Kingdom . |
| 1486519 | 9/1977 | United Kingdom . |
| 2022897 | 12/1979 | United Kingdom . |
| 2047936 | 12/1980 | United Kingdom . |
| 2070307 | 9/1981 | United Kingdom . |
| 2105893 | 3/1983 | United Kingdom . |
| 2135094 | 8/1984 | United Kingdom . |
| 8300400 | 2/1983 | WIPO . |

*Primary Examiner*—Michael S. Huppert
*Assistant Examiner*—Scott L. Lowe
*Attorney, Agent, or Firm*—Rothwell, Figg, Ernst & Kurz

[57] ABSTRACT

Procedure for verifying coins in which an analog electrical signal is generated when a coin passes in front of a sensor. This signal is subjected to analog-digital conversion. In a first filtration step, each of the measured digital values ($D_n$) obtained in this manner is compared with at least one value ($S_1$ to $S_n$) stored in a memory. In the event of predetermined conditions being met or not being met, the average digital value ($D_n$) is either stored or eliminated.

5 Claims, 1 Drawing Sheet

PROCEDURE FOR PROCESSING ELECTRICAL SIGNALS USED IN VERIFYING COINS

FIELD OF THE INVENTION

This invention concerns a procedure for verifying coins in which a coin is passed in front of a sensor which generates an electrical signal that is processed to remove undesired signals

DESCRIPTION OF THE PRIOR ART

Via European patent application EP 246 993 A2, a procedure of this general type is known, with a coin verifier that contains a sensor for verifying the respective coin. After its introduction, the coin is moved along a track and arrives, among others, at the measuring zone of the sensor's electromagnetic coils. As it passes through the measuring zone the sensor generates an analog output signal, which is particularly dependent on the material of the respective coin. Stored in a memory are characteristic values for the types of acceptable coins, which must be verified with the coin verifier, here referring solely by way of example to maximum or minimum values. These stored characteristic values are compared in a comparison facility with the values of the output signal from the sensor in order to identify in this way whether the respective coin is an acceptable coin or a false coin. Since the output signal can in practice be altered by perturbations, difficulties arise in the assessment and comparison of the analog electrical output signal. The output signal contains both the useful signal created by the coin and also perturbing signals, the quality of purity of the output signal being defined by the ratio, usually stated in dB, between the useful signal and the perturbing signal. The optimization of this ratio has so far been achieved by means of the careful formation and selection of the sensor's individual components, which leads to considerable expense in practice. On the other hand, procedures have already been proposed for the formation of the average or filtration value and adapted filters are referred to here in particular, such as the low-pass filter, bandpass filter or high-pass filter. Filters of this type are normally designed with R-C members and are not especially efficient in the case of pulse-shaped perturbing signals that can appear, for example due to electrostatic discharges, sudden interruptions or point voltages in the power supply caused by the connection of relays or the switching on of fluorescent tubes or similar devices. Such perturbing signals basically contain high energy, have a very short duration and cover a high level of the spectral frequency. As a result, pulse-shaped perturbing signals, also known as HITS, lead to considerable mistakes in measuring output signals. Because of these perturbing pulses, correct coins are rejected along with false ones, which in practice is a significant drawback when it comes to the functional reliability and security of this type of coin verifier.

SUMMARY OF THE INVENTION

Accordingly, the invention has the task of developing the procedure of the type mentioned above such that perturbing signals can be reliably recognized and suppressed for later assessment. The coin verifier must show a high functional security and be safe against all contra perturbing pulses produced outside.

The procedure according to the invention makes it possible to precisely determine the development of the signal induced by the coin. The procedure includes the filtration process as essential stages. In the first filtration, the signal is registered, undersired perturbing signals are eliminated and they are stored in a memory or register containing a predetermined number of memory spaces for the predetermined values. The analog signal obtained by the sensor is converted in an analog-digital converter into measured digital values, each measured value defined in this way being compared with at least one of the already stored values, with the predetermined conditions being taken into account. In a second stage of the procedure, the determination is made of significant values and, in particular, especially the minimum or maximum values. This second filtration is done starting from a predetermined number of values, and specifically on the basis of the values that are repeated the most times. By virtue of this double filtration, perturbing pulses are eliminated with particularly high reliability. The procedure can be carried out with comparatively low cost electronic circuits. By means of providing limit values, the precision is optimized in an especially convenient way and in particular taking into account the specific and expected development of the signal from the different coins that are led to the coin verifier. In the second filter, the respective extreme value is established starting from the stored values and, depending on the case, this value is finally stored as such.

BRIEF DESCRIPTION OF THE DRAWINGS

Below, the invention is explained in detail with the help of an example of it being carried out in practice as shown in the diagrams, and without this example placing any restriction on the invention.

DETAILED DESCRIPTION OF THE DRAWINGS

Figure 1:
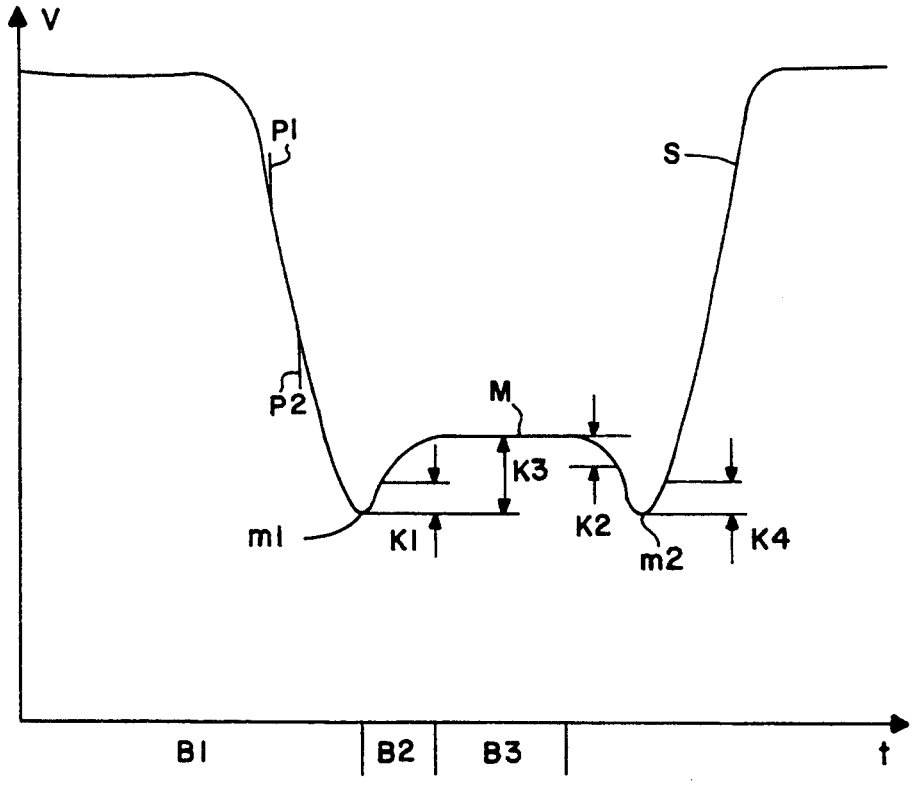
FIG. 1 shows the analog signal supplied by the sensor with positive and negative perturbing pulses.

FIG. 1 shows by way of example the analog signal S generated as a voltage by means of an electromagnetic sensor when a coin passes in front of the sensor, measured as a function of time t. This signal S first falls in a zone B1 from the starting value to a first minimum m1 and then rises again to a zone B2 and, in zone B3, reaches a maximum Max. From here the signal falls again, reaching a second minimum value m2, and then rises to the initial value. The signal S represented here only in principle owes its specific shape both to the structure of the sensor and to the size and especially the material of the respective coin. It must be pointed out that the rises of zones B1 and B2 and the absolute values of the minima and of the maximum will certainly be different, but in principle a comparable development of the signal exists. The development of the signal itself can be altered by means of positive and/or negative pulses. Shown here solely by way of example are two perturbing pulses of this type, P1 and P2, though in practice a plurality of perturbing signals of this type can appear over the total development of the signal curve.

Figure 2:
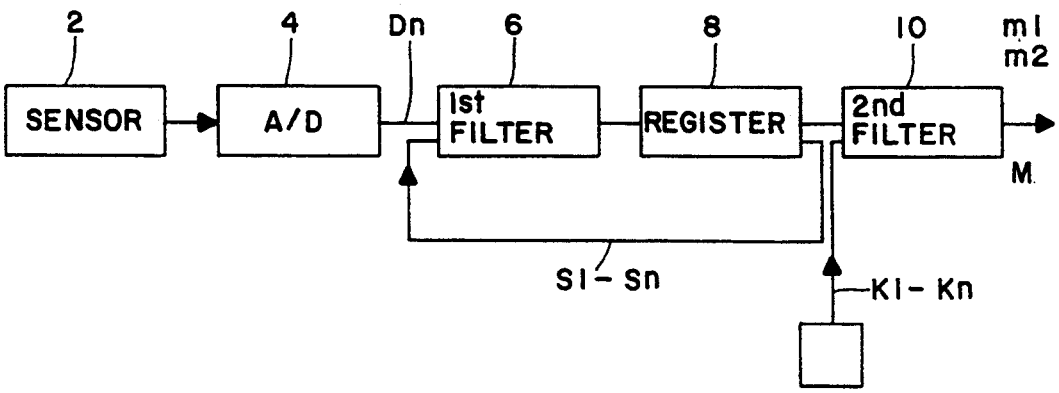
FIG. 2 shows a block diagram for carrying out the procedure according to the present invention.

FIG. 2 shows a block diagram for carrying out the procedure according to the invention. The electromagnetic sensor 2 supplies the analog signal S, whose basic development has been explained with the help of FIG. 1. Located behind this sensor is an analog-digital converter 4 which supplies the corresponding measured digital values. These measured digital values are also altered in the same way as the analog signals by virtue of perturbing pulses. So, for example, in zone B1 the consecutive measured digital values do not show any uniform descending trend and instead are either too large or too small depending on the sign of the respective perturbing pulse.

The consecutive measured digital values are therefore subjected to a first filtration, as represented by the first filter 6. Moreover, a register B is provided which has a predetermined number of memory spaces, in particular at least four memory spaces of this type. By means of the first filter 6, each measured digital value is compared with at least one of the values stored in the register 8, taking into account the predetermined conditions. In general, memory 8 contains a number "n" of memory spaces in which values $S_1$ to $S_n$ can be stored. Below, the values currently contained in the memory 8 are designated with letters.

On the one hand, this starts from the fact that for zone B1 the latest values stored in memory 8 are stored with the values "a" to "d", as represented symbolically below:

a b c d

If the following value $D_n$ read and led to the filter 6 is essentially less than the latest stored value "d", then the values in the memory are displaced one position respectively, and the value $D_n$ is stored as "e". The value "a" disappears and the memory occupancy is then:

b c d e

On the contrary, if the value read in $D_n$ is greater than the latest stored value "d", and essentially less than the last but one value "c", then it is a perturbing signal, which is eliminated by filtration by virtue of these conditions and is not introduced into the register 8. The predetermined conditions are adapted to the descending trend of the measured digital values in zone B1.

The values stored in the register 8 by virtue of the first filtration are subjected for the determination of the significant extreme values and, in particular, first that of the first minimum ml following a second filtration, as represented by means of a second filter 10. For the second filtration, this starts in the first place with the values shown below being stored in memory 8:

i k o p

The value that appears repeated most times in these four stored values i to p must in the first place be taken as maximum. If two stored values are respectively equal to each other, then they will act as the two smallest values, respectively. These confirmations and comparisons are carried out whenever the latest value read $D_n$ is greater than the last two stored values, for example, "o" and "p".

This stage of the procedure is carried out whenever the latest measured digital value read $D_n$ is greater than the last two stored values, and lastly in a convenient way the value determined in this manner is finally stored as the first minimum ml when two of the values determined in this way are greater than the value defined as minimum in addition to a predetermined limit value K1.

For the following zone B2, in which the measured digital values rise, the conditions for the first filtration with filter 6 are inverted. The explanation starts from the following four values being stored in memory 8:

A B C D

If the lastest value read $D_n$ is essentially greater than the latest value stored D, then the value read $D_n$ is stored as the new value E. The stored values go back one position in the register and in the memory and value A disappears. The other comparative criteria valid for zone B1 are also inverted in order to make an adaptation to the ascending trend of the values in zone B2.

For the determination of the maximum M, this starts from the fact that, by virtue of the confirmations explained, and taking into account the stated criteria, the following values are stored in memory 8:

I K Q P

Provided that the latest read value D is less than the values P and Q, the determination of the maximum will be made, the selection of the most repeated values from among the stored values being carried out. In the event of two of these values being equal, respectively, the greater will be selected as the maximum. Lastly, the maximum determined in this manner is finally stored as soon as two of the successively read values $D_n$ and $D_{n+1}$ are less than the maximum selected in the manner explained, and taking into account in particular another limit value K2. Furthermore, it is borne in mind that the difference between the maximum M and the minimum m1 is greater than another predetermined limit value K3.

In zone B3, in which the digital values again have a descending trend, the determination of the second minimum m2 is done is accordance with the determination of the first minimum m1. Instead of the limit value K1, the limit value K4 now counts. Otherwise, the condition that the difference between the maximum M and the second minimum m2 must suitably reach the predetermined limit value K5 is valid. If these limit values are not reached, the analog signal then does not have the shape explained with the help of FIG. 1, but instead has a comparatively simple shape with a single minimum.

I claim:

1. A procedure for processing electrical signals used in the verification of coins, the procedure comprising steps of:

passing a coin in front of a sensor which generates an electrical analog signal in response to the coin;

converting the analog signal into a plurality of measured digital values;

filtering the plurality of measured digital values to remove values corresponding to undesired signals, said filtering being performed by comparing each measured digital value to at least one of a plurality of predetermined values stored in a memory to determine whether each measured digital value corresponds to a useful signal value and should be stored, or to an undesirable signal value and should be eliminated; and storing the useful measured digital values.

2. A procedure for processing electrical signals used in the verification of coins according to claim 1, wherein the memory has a predetermined number of memory locations and said plurality of predetermined values are stored in respective memory locations, and said filtering step is performed by comparing each measured digital value with at least one of said predetermined values such that, depending on which of the respective values is greater, the determination as to whether the measured digital value should be stored or eliminated is made.

3. A procedure for processing electrical signals used in the verification of coins according to claim 1, wherein the measured digital values obtained and stored in the memory via said filtering step are subjected to a second filtering step to determine at least one of the maxima and minima values of the analog signal generated by the sensor.

4. A procedure for processing electrical signals used in the verification of coins according to claim 3, wherein the second filtering step includes steps of:

(a) comparing the most recent measured digital value to at least one of the stored values obtained by the first filtering step to determine whether the most recent measured digital value is less than or greater than the at least one stored value;

(b) determining which of the stored values obtained by the first filtering step is repeated the most times among said stored values;

(c) if the comparison of step (a) shows that the most recent measured digital value is greater than the at least one stored value, comparing the value obtained in step (b) to two successively measured digital values and, if the two successively measured digital values are greater than the value obtained in step (b) plus a first preset value, storing the value obtained in step (b) as a minima value of the signal generated by the sensor; and (d) if the comparison of step (a) shows that the most recent measured digital value is less than the at least one stored value, comparing the value obtained in step (b) to two successively measured digital values and, if the two successively measured digital values are less than the value obtained in step (b) plus a second preset value, storing the value obtained in step (b) as a maxima value of the signal generated by the sensor.

5. A procedure for processing electrical signals used in the verification of coins according to claim 4, wherein the most recent measured digital value is compared to two of the stored values obtained by the first filtering step to determine whether the most recent measured digital value is less than or greater than the two stored values.

* * * * *